US009358434B2

(12) United States Patent
Bamber

(10) Patent No.: US 9,358,434 B2
(45) **Date of Patent: *Jun. 7, 2016**

(54) GOLF CLUBS

(75) Inventor: Jeffrey Vincent Bamber, Cincinnati, OH (US)

(73) Assignee: Pelican Gold, Inc., Cincinnati, OH (US)

( * ) Notice: Subject to any disclaimer, the term of this patent is extended or adjusted under 35 U.S.C. 154(b) by 157 days.

This patent is subject to a terminal disclaimer.

(21) Appl. No.: 12/924,426

(22) Filed: Sep. 27, 2010

(65) Prior Publication Data

US 2011/0124436 A1 May 26, 2011

Related U.S. Application Data

(63) Continuation of application No. 11/357,313, filed on Feb. 17, 2006, now Pat. No. 7,815,524.

(60) Provisional application No. 60/653,775, filed on Feb. 17, 2005.

(51) Int. Cl.
*A63B 53/04* (2015.01)
*A63B 69/36* (2006.01)

(52) U.S. Cl.
CPC ..... *A63B 53/047* (2013.01); *A63B 69/3632* (2013.01); *A63B 53/0466* (2013.01); *A63B 2053/0433* (2013.01); *A63B 2053/0445* (2013.01); *A63B 2053/0491* (2013.01)

(58) Field of Classification Search
CPC ..... A56N 53/04
USPC ..... 473/349
See application file for complete search history.

(56) References Cited

U.S. PATENT DOCUMENTS

| | | | |
|---|---|---|---|
| 645,942 | A | 3/1900 | Cran |
| 1,089,881 | A | 3/1914 | Taylor, Jr. |
| 1,128,288 | A | 2/1915 | Churchill |
| 1,320,163 | A | 10/1919 | Fitz |

(Continued)

OTHER PUBLICATIONS

E. Michael Johnson, Equipment—Nike Slingshot Hybrid, Golf World magazine, Feb. 3, 2006, p. 14, The Golf Digest Publications, NY, NY, USA.

(Continued)

*Primary Examiner* — Michael Dennis

(57) ABSTRACT

Golf clubs having improved features and a golf swing training device are disclosed. In one embodiment, the golf club has a club head made of at least one material having a first specific gravity, and at least one weighting portion that has a higher specific gravity than the first specific gravity of the material forming the main body of the club head. In another embodiment, the golf club has a club head of the "iron" type, and the club head has a sole that is provided with "bounce" thereon. In another embodiment, the golf club has a club head of the "iron" type that has a configuration that provides it with improved ability to cut through the "rough" on the golf course. In another embodiment, the golf club has a club head having a club face with at least one portion thereof that has a thickness that is modified to account for a groove in the striking surface of the club face. In another embodiment, correlated golf clubs are provided in which the club face is opened or closed relative to at least one other club within a set of golf clubs. The golf swing training device has a structure that is attached to the golf club and extends outward from the front of the golf club that makes the rotation of the golf club shaft and/or club face more visible to the golfer.

19 Claims, 5 Drawing Sheets

(56) References Cited

U.S. PATENT DOCUMENTS 1,594,850 A 8/1926 Perkins
1,969,086 A 11/1930 Luckett
1,840,924 A 1/1932 Tucker
2,087,685 A 7/1937 Hackney
2,174,212 A 9/1939 Newsome
2,460,435 A 2/1949 Schaffer
2,691,525 A 10/1954 Callaghan, Sr.
2,846,228 A 10/1955 Reach
2,998,254 A 8/1961 Rains et al.
3,064,980 A 11/1962 Steiner
3,606,327 A 9/1971 Gorman
3,655,188 A 4/1972 Solheim
3,722,887 A 3/1973 Cochran et al.
3,845,960 A 11/1974 Thompson
D234,782 S 4/1975 Creed
3,961,796 A 6/1976 Thompson
3,979,122 A 9/1976 Belmont
3,995,858 A 12/1976 Cochran et al.
4,145,052 A 3/1979 Janssen et al.
4,326,326 A 4/1982 MacDonald
4,534,558 A 8/1985 Yoneyama
4,607,846 A 8/1986 Perkins
4,621,813 A 11/1986 Solheim
4,667,963 A 5/1987 Yoneyama
4,671,513 A 6/1987 Swanson
4,699,383 A 10/1987 Kobayashi
4,824,110 A 4/1989 Kobayashi
4,826,172 A 5/1989 Antonious
4,852,880 A 8/1989 Kobayashi
4,883,274 A 11/1989 Hsien
4,884,812 A 12/1989 Nagasaki et al.
4,915,386 A 4/1990 Antonious
4,919,430 A 4/1990 Antonious
4,928,972 A 5/1990 Nakanishi et al.
4,955,610 A 9/1990 Creighton et al.
5,004,242 A 4/1991 Iwanga et al.
5,009,425 A 4/1991 Okumoto et al.
5,013,041 A 5/1991 Sun et al.
5,016,883 A 5/1991 Kobayashi
5,026,056 A 6/1991 McNally et al.
5,046,733 A 9/1991 Antonious
5,048,834 A 9/1991 Gorman
5,050,879 A 9/1991 Sun et al.
5,074,563 A 12/1991 Gorman
5,110,131 A 5/1992 Long
5,120,061 A 6/1992 Tsuchida et al.
5,193,805 A 3/1993 Solheim
5,230,510 A 7/1993 Duclos
5,242,167 A 9/1993 Antonious
5,263,717 A 11/1993 McCallister
5,280,911 A 1/1994 Katayama
5,297,803 A 3/1994 Solheim
5,312,105 A 5/1994 Cleveland
5,312,106 A 5/1994 Cook
5,326,106 A 7/1994 Meyer
5,328,184 A 7/1994 Antonious
5,330,187 A 7/1994 Schmidt et al.
5,335,914 A 8/1994 Long
D354,103 S 1/1995 Allen
D354,325 S 1/1995 Henwood
5,377,985 A 1/1995 Ohnishi
D355,944 S 2/1995 Bendo
5,390,924 A 2/1995 Antonious
5,395,109 A 3/1995 Fenton, Jr.
5,401,021 A 3/1995 Allen
5,409,229 A 4/1995 Schmidt et al.
5,419,560 A 5/1995 Bamber
5,421,577 A 6/1995 Kobayashi
5,429,353 A 7/1995 Hoeflich
5,435,559 A 7/1995 Swisshelm
5,439,223 A 8/1995 Kobayashi
D363,100 S 10/1995 Long et al.
5,465,970 A 11/1995 Adams et al.
5,492,327 A 2/1996 Biafore, Jr.
5,505,448 A 4/1996 Park
5,540,436 A 7/1996 Boone
5,540,437 A 7/1996 Bamber
5,549,297 A 8/1996 Mahaffey
D375,130 S 10/1996 Hlinka et al.
5,584,770 A 12/1996 Jensen
5,586,947 A 12/1996 Hutin
5,616,088 A * 4/1997 Aizawa et al. ..... 473/341
5,669,830 A 9/1997 Bamber
5,695,411 A 12/1997 Wright et al.
5,713,800 A 2/1998 Su
5,738,596 A 4/1998 Meyer
5,749,794 A 5/1998 Kobayashi et al.
5,795,245 A 8/1998 Chang et al.
5,827,132 A 10/1998 Bamber
5,833,551 A 11/1998 Vincent et al.
D404,780 S 1/1999 Long
5,913,735 A 6/1999 Kenmi
5,916,041 A * 6/1999 Antonious ..... 473/328
5,967,905 A 10/1999 Nakahara et al.
5,976,033 A 11/1999 Takeda
6,030,293 A 2/2000 Takeda
6,030,295 A 2/2000 Takeda
6,080,069 A 6/2000 Long
6,123,627 A 9/2000 Antonious
6,186,903 B1 2/2001 Beebe et al.
6,224,494 B1 5/2001 Patsky
D443,320 S 6/2001 Breier et al.
6,251,029 B1 6/2001 Roberts
6,280,348 B1 8/2001 Stites
D447,781 S 9/2001 Pechal
6,290,607 B1 9/2001 Gilbert et al.
6,290,608 B2 9/2001 Gates
6,290,609 B1 9/2001 Takeda
6,348,014 B1 2/2002 Chiu
6,386,990 B1 5/2002 Reyes et al.
6,406,382 B1 6/2002 Deshmukh et al.
6,440,010 B1 8/2002 Deshmukh
6,450,897 B2 9/2002 Stites et al.
6,488,595 B1 12/2002 Grace
6,533,679 B1 3/2003 McCabe et al.
6,554,719 B2 * 4/2003 Peters et al. ..... 473/291
6,592,469 B2 7/2003 Gilbert
6,659,882 B2 12/2003 Patsky
6,702,693 B2 3/2004 Bamber
6,746,344 B1 6/2004 Long
6,773,360 B2 8/2004 Willett et al.
6,773,361 B1 8/2004 Lee
D499,155 S 11/2004 Imamoto
6,843,733 B1 1/2005 Llewellyn et al.
6,855,067 B2 2/2005 Solheim et al.
6,860,819 B2 3/2005 Gilbert
6,863,624 B1 3/2005 Kessler
6,887,165 B2 5/2005 Tsurumaki
6,896,625 B2 5/2005 Grace
6,929,563 B2 8/2005 Nishitani
7,004,853 B2 2/2006 Deshmukh et al.
7,018,304 B2 3/2006 Bradford
7,022,027 B2 4/2006 Chen
7,022,033 B2 4/2006 Bamber
D520,584 S 5/2006 Karlsen
7,077,763 B2 7/2006 Wahl et al.
7,083,531 B2 8/2006 Aguinaldo et al.
7,121,956 B2 10/2006 Lo
7,128,663 B2 10/2006 Bamber
7,147,573 B2 12/2006 DiMarco
7,166,040 B2 1/2007 Hoffman et al.
7,166,041 B2 1/2007 Evans
7,186,190 B1 3/2007 Beach et al.
7,223,180 B2 5/2007 Willett et al.
D544,055 S 6/2007 Wieland et al.
D545,389 S 6/2007 Glod
D556,278 S 11/2007 Mahaffey et al.
7,815,524 B2 10/2010 Bamber
2001/0001774 A1 5/2001 Antonious
2001/0007834 A1 7/2001 Gates
2002/0183134 A1 12/2002 Allen et al.
2003/0139225 A1 7/2003 Rife
2003/0144075 A1 7/2003 Cullen
2003/0144077 A1 7/2003 Cullen

(56) References Cited

U.S. PATENT DOCUMENTS

| | | | |
|---|---|---|---|
| 2004/0043830 | A1 | 3/2004 | Imamoto |
| 2005/0085313 | A1 | 4/2005 | Nishitani |
| 2005/0090332 | A1 | 4/2005 | Burrows |
| 2005/0137024 | A1 | 6/2005 | Stites et al. |
| 2005/0170908 | A1 | 8/2005 | Reyes et al. |
| 2005/0239572 | A1 | 10/2005 | Roach et al. |
| 2005/0250598 | A1 | 11/2005 | Stites et al. |
| 2005/0266932 | A1 | 12/2005 | Roach et al. |
| 2005/0288124 | A1 | 12/2005 | Galloway et al. |
| 2006/0025234 | A1 | 2/2006 | Nicolette et al. |
| 2006/0025237 | A1 | 2/2006 | Aguinaldo et al. |
| 2006/0058113 | A1 | 3/2006 | Hasegawa |
| 2006/0084527 | A1 | 4/2006 | Nycum et al. |
| 2006/0094522 | A1 | 5/2006 | Tang et al. |
| 2006/0100033 | A1 | 5/2006 | Nelson et al. |
| 2007/0042834 | A1 | 2/2007 | Nicolette et al. |
| 2007/0042837 | A1 | 2/2007 | Bamber |
| 2007/0219017 | A1 | 9/2007 | Wieland et al. |
| 2008/0020861 | A1 | 1/2008 | Adams et al. |

OTHER PUBLICATIONS

Karsten Manufacturing Corporation, PING® G10 and i10 iron advertisement, Golf World magazine, Sep. 14, 2007, back cover (p. 54), The Golf Digest Publications, NY, NY, USA.

Author Unknown, The Starter—Track Star Mizuno MP-600 driver, pp. 26-27; The Starter—Leaders of the Rack, Callaway X-20 irons, p. 31, Golf Magazine, Dec. 2007, vol. 49, No. 12, TI Golf Holdings, Inc., NY, NY, USA.

Acushnet Company, COBRA® UFi iron advertisement, p. 28, Golf Magazine, Dec. 2007, vol. 49, No. 12, TI Golf Holdings, Inc., NY, NY, USA.

Tom Cunneff, 2008 Equipment, Irons, p. 76, Links Magazine, Mar. 2008, Purcell Enterprises, Inc., Hilton Head, S.C., USA.

* cited by examiner

GOLF CLUBS

CROSS-REFERENCE TO RELATED APPLICATIONS

This application claims the benefit of provisional U.S. Patent Application Ser. No. 60/653,775 filed on Feb. 17, 2005, and is a continuation of U.S. patent application Ser. No. 11/357,313, now U.S. Pat. No. 7,815,524 filed on Feb. 17, 2006, both of which are incorporated by reference herein.

FIELD OF THE INVENTION

The present invention relates to golf clubs, and more particularly to golf clubs having improved features. Another invention described herein is a golf swing training device.

BACKGROUND OF THE INVENTION

Patents relating to golf clubs include U.S. Pat. Nos. 5,419,560; 5,540,437; and 6,702,693 B2, and the references listed on the face and any subsequent pages thereof. A patent application relating to a golf swing training device is US 2003/0083140 A1.

SUMMARY OF THE INVENTION

The present invention relates to golf clubs, and more particularly to golf clubs having improved features. Another invention described herein is a golf swing training device.

There are numerous, non-limiting embodiments of the invention. All embodiments, even if they are only described as being "embodiments" of the invention, are intended to be non-limiting (that is, there may be other embodiments in addition to these), unless they are expressly described as limiting the scope of the invention. Any of the embodiments described herein can also be combined with any other embodiments in any manner to form still other embodiments.

In one embodiment, the golf club comprises a club head having at least one weighting element that is made of a higher specific gravity material than the specific gravity of the material comprising the remainder of the club head. The weighting element can be positioned at various locations on the back of the club head and/or around the periphery of the club head, or on the hosel of the club head.

In another embodiment, the golf club comprises a club head extensions that extend laterally outward at the bottom of the club head.

In another embodiment, the golf club comprises a club head of the "iron" type, and the club head has a sole that is provided with "bounce" thereon.

In another embodiment, the golf club comprises a club head having a club face with at least one portion thereof that has a thickness that is modified to account for a groove in the striking surface of the club face.

In another embodiment, correlated golf clubs are provided in which the club face is opened or closed relative to at least one other club within a set of golf clubs.

The golf swing training device comprises a structure that is attached to the golf club and extends outward from the front of the golf club that makes the rotation of the golf club shaft and/or club face more visible to the golfer.

Other embodiments are also contemplated.

BRIEF DESCRIPTION OF THE DRAWINGS

While the specification concludes with claims particularly pointing out and distinctly claiming the present invention, it is believed the invention will be better understood from the following description taken in conjunction with the accompanying drawings.

DETAILED DESCRIPTION OF THE INVENTION

The present invention relates to golf clubs, and more particularly to golf clubs having improved features.

Figure 1:
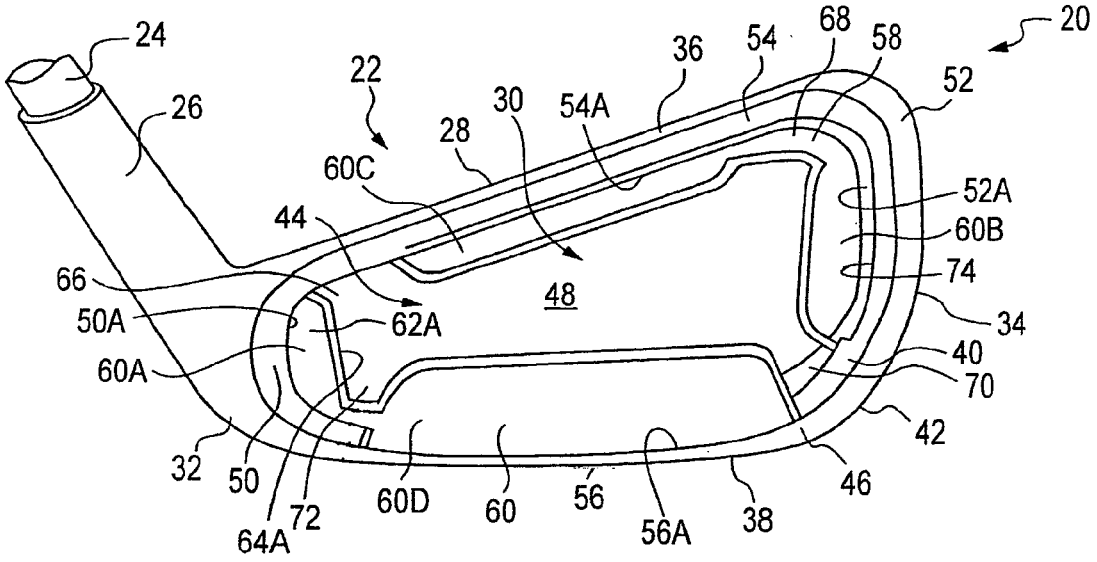
FIG. 1 is a rear elevation view of one embodiment of a golf club head which has more than one weighted region.

FIG. 1 shows one embodiment of a golf club 20. The golf club 20 comprises a club head 22 and a shaft 24. The club head 22 shown in FIG. 1 is of the "iron" type. It should be understood, however, that the features described herein are also applicable to "wood" or "metal wood" club heads, and to "hybrid" club heads which combine the features of irons and metal woods. The club head 22 comprises a hosel 26 connected to the lower end of the shaft 24. The hosel 26 is integrally formed with the club head in this embodiment. The club head 22 also comprises a club face 28, a back surface 30, a heel or heel portion 32, a toe or toe portion 34, a top edge 36, and a sole 38. It should be understood that in other embodiments, the hosel 26 may be a separate component. In other embodiments, the hosel 26 may be optional.

The club head 22 comprises a main body 40. The term "main body", as used herein, refers to the larger portion of the club head 22 relative to any higher specific gravity weighting portions of the club head 22. The main body 40 has a periphery 42. The periphery 42 of the main body 40 may comprise portions at the club face 28, the back surface 30, the heel portion 32, the toe portion 34, the top edge 36, and the sole 38 of the club head 22. The main body 40 of the club head 22 can comprise one or more materials. The main body 40 of the club head 22 can be made of any suitable material or materials. Suitable materials include, but are not limited to stainless steel, titanium, graphite, aluminum, polymeric material, plastic, or combinations thereof. The main body 40 of the club head 22 can be made in any suitable manner including, but not limited to forging, casting, or joining one or more forged, cast, or otherwise formed, pieces together in any suitable manner. Suitable manners for joining such pieces together include, but are not limited to using mechanical fasteners, adhesives, welds, friction fitting, or any other known manners of attachment.

The embodiment of the golf club head 22 shown in FIG. 1 is perimeter weighted. The back surface 30 of the club head has a central region 48 with a cavity 44 therein. The cavity 44 is at least partially surrounded by thicker perimeter weighted portions 46 extending rearward on the back surface 30 of the club head 22 that provide the club head 22 with increased weight around at least part of its perimeter. The perimeter weighted portions 46 of the club head 22 in the embodiment shown include perimeter weighted portions along the heel 32, the toe 34, the top edge 36, and the sole 38 of the club head. These perimeter weighted portions are designated by reference numbers 50, 52, 54, and 56, respectively.

The perimeter weighted portions 50, 52, 54, and 56 each have an inner surface, 50A, 52A, 54A, and 56A, respectively, which are the surfaces thereof disposed closest to the central region 48 of the club head. The perimeter weighted portions 50, 52, 54, and 56 also have an outer surface, 50B, 52B, 54B, and 56B, respectively (labeled in FIG. 4), which are disposed along the heel 32, the toe 34, the top edge 36, and the sole 38 of the club head. The perimeter weighted portions 50, 52, 54, and 56 also have a rear surface, 50C, 52C, 54C, and 56C, respectively (labeled in FIG. 3), which are disposed along the heel 32, the toe 34, the top edge 36, and the sole 38 of the club head. It should be understood that the embodiments shown in FIGS. 1-4 are not intended to limit the present invention, and that in other embodiments, the club head 22 may not have one or more of these perimeter weighted portions. In other embodiments, the club head 22 need not be perimeter weighted. For example, in the case of iron club heads, the club head 22 may not have a cavity or perimeter weighting, and may be of the "blade" type. Metal woods and hybrid clubs also may, but need not be perimeter weighted.

The club head 22 shown in FIG. 1 comprises at least one weighting portion 60 comprising a material (or more than one different material) of higher specific gravity joined to the main body 40 of the club head 22 in a particular location. FIG. 1 shows one non-limiting embodiment of a club head 22 comprising first 60A, second 60B, third 60C, and fourth 60D higher specific gravity weighting portions, which are designated generally by reference number 60. The term "joined", as used herein, encompasses configurations in which an element is directly secured to another element by affixing the element directly to the other element; configurations in which the element is indirectly secured to the other element by affixing the element to intermediate member(s) which in turn are affixed to the other element; and configurations in which one element is integral with another element, i.e., one element is essentially part of the other element. The term "joined" includes both those configurations in which an element is temporarily joined to another element, or in which an element is permanently joined to another element.

The higher specific gravity weighting portions 60 can be joined to the main body 40 of the club head 22 in any suitable manner. Suitable manners for joining the higher specific gravity weighting portions 60 include, but are not limited to: adhesive attachment, welded connections, threaded connections, friction fitting, casting in place, and by at least partially by covering or enclosing the higher specific gravity weighting portion 60 with another element. In some embodiments, however, it may be desirable for the manner of joining the higher specific gravity weighting portions 60 to the main body 40 of the club head 22 to exclude one or more of such types of attachments.

The phrase "higher specific gravity", as used herein, means higher specific gravity than at least some portion of the main body 40 of the club head 22. The higher specific gravity weighting portions 60 may have a higher specific gravity than the portion(s) of the main body of the club head 22 with the highest specific gravity. In other embodiments, the higher specific gravity weighting portions 60 may have a higher specific gravity than at least some other portion of the main body 40 of the club head 22. Non-limiting examples of materials with higher specific gravity include: lead, brass, and tungsten. Such materials would have a higher specific gravity than stainless steel, for example, which may form at least a portion of the main body 40 of the club head 22.

The higher specific gravity weighting portions 60 described herein refer to higher specific gravity material that is supplied by the manufacturer either as part of the club head 22, or together with, or for the club head 22 as a component for the club head 22 which is intended to be inserted into, or otherwise added to the club head 22. That is, the higher specific gravity weighting portions 60 described herein are those that are intended to be offered for use as part of the club head, as manufactured. The higher specific gravity weighting portions 60 referred to herein are intended to be distinguished from higher specific gravity material, such as lead tape, which may be obtained and subsequently cut and applied to the club head by a golfer, but is not a part of a pre-fabricated weighting system for a particular club head. The higher specific gravity weighting portions 60 may, in certain embodiments, be sized and configured for joining the same to one or more particular regions of the main body 40 of the club head 22. Such regions of the main body 40 of the club head 22 include, but are not limited to recesses in the main body 40 that are sized and/or configured to receive one or more of the weighting portions 60.

Figure 2:
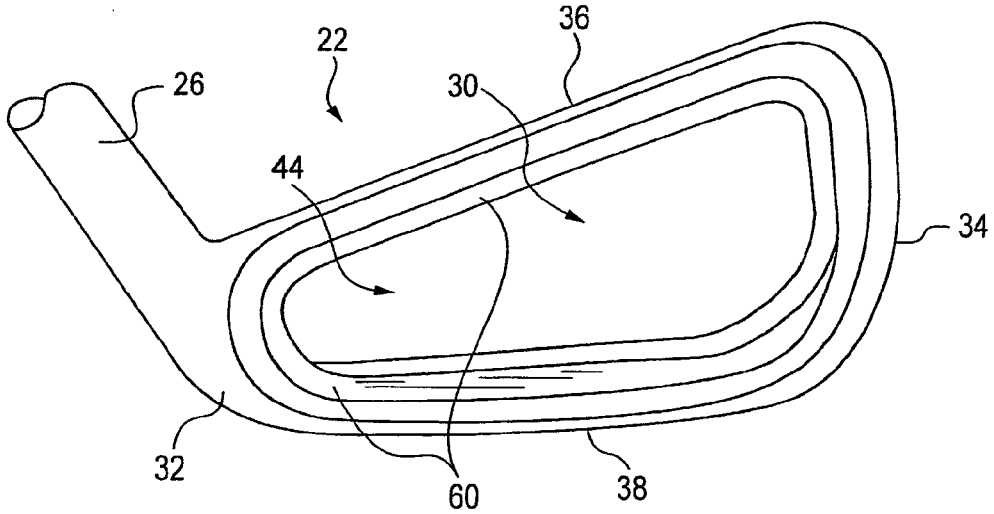
FIG. 2 is a rear elevation view of another embodiment of a golf club head which has a weighted region around the inside of its weighted perimeter portion.
Figure 3:
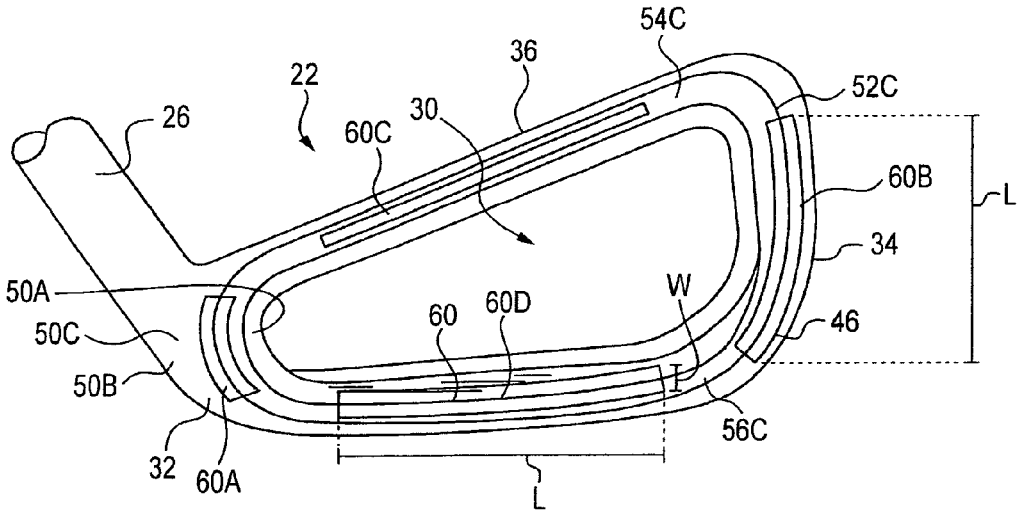
FIG. 3 is a rear elevation view of another embodiment of a golf club head which has weighted regions within its weighted perimeter portion.
Figure 4:
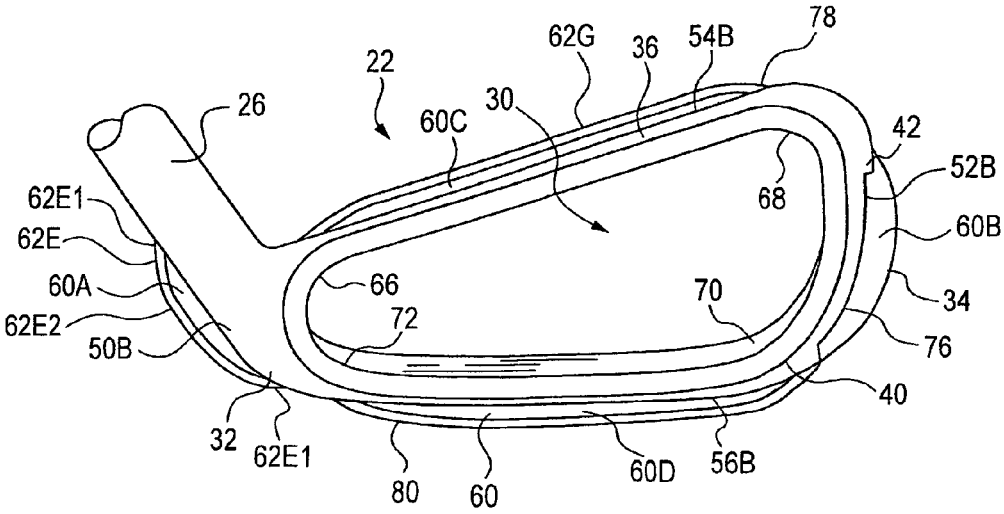
FIG. 4 is a rear elevation view of another embodiment of a golf club head which has weighted regions outside its weighted perimeter portion.

The higher specific gravity weighting portions 60 can be located in any suitable relationship with respect to the main body 40 of the club head 22. The higher specific gravity weighting portions 60 may be located inside the cavity 44 of a perimeter weighted club head as shown in FIGS. 1 and 2. In other embodiments, the higher specific gravity weighting portions 60 may be located within at least a portion of the main body 40 of the club head 22 as shown in FIG. 3. In other embodiments, the higher specific gravity weighting portions 60 may be located outside of the main body 40 of the club head 22 as shown in FIG. 4. Any combinations of these embodiments are also possible, such as those in which the club head has one or more higher specific gravity weighting portions 60 in a location inside a cavity, within a portion of the main body 40, or outside of the main body 40.

The club head 22 can have any suitable number of higher specific gravity weighting portions 60. Suitable numbers of higher specific gravity weighting portions 60 include, but are not limited to: 1, 2, 3, 4, 5, 6, 7, 8, . . . , etc. The higher specific gravity weighting portions 60 can be of any suitable configuration and size. As shown in the drawings, it is not necessary that all of the higher specific gravity weighting portions 60 have the same configuration, or be of the same size. If there is more than one higher specific gravity weighting portion 60, any two or more higher specific gravity weighting portions 60 may differ in configuration and/or size.

The higher specific gravity weighting portions 60 may have a regular-shaped, or an irregularly-shaped configuration. The higher specific gravity weighting portions 60 may also comprise structures that have one or more regularly-shaped sides and one or more irregularly-shaped sides. The higher specific gravity weighting portions 60 may be symmetrical, or asymmetrical about one or more axis. The higher specific gravity weighting portions 60 can have rectilinear shapes, curvilinear shapes, or they can comprise portions having both types of shapes. The aforementioned shapes can be seen when the higher specific gravity weighting portions 60 are viewed from a given direction (including, but not limited to the back surface of the club head 22). Examples of regular-shaped configurations include, but are not limited to: cubes, parallelepipeds, any other known polygon shapes, spheres, cylinders, and other geometric shapes. In some embodiments, however, it may be desirable for the higher specific gravity weighting portions 60 to exclude certain of these configurations (e.g., spherical or cylindrical).

The higher specific gravity weighting portions 60 can have any suitable dimensions (e.g., length, width, or thickness). The higher specific gravity weighting portions 60 can have any suitable dimensions relative to the adjacent portion (or portions) of the main body 40, such as the perimeter weighted portions 46. As used herein in reference to the weighting portions 60 (and in reference to the partitions described hereinafter), the term "length", L, refers to the dimension of the same that is oriented or aligned most nearly to the side (e.g., the heel 32, toe 34, top 36, or sole 38) of the club head 22 adjacent thereto. As used in reference to the weighting portions 60 (and the partitions), the term "width", W, refers to the dimension of the same that is oriented most nearly perpendicular to the side of the club head adjacent thereto. FIG. 3 shows the application of these dimensions to two weighting portions 60. The thickness of the weighting portions 60 is their dimension measured in the direction from the front of the club head 22 to the back 30 of the club head 22.

The higher specific gravity weighting portions 60 can have dimensions (e.g., length, width, or thickness) that are: less than; greater than; or substantially the same as that of the adjacent portion of the main body 40. Suitable dimensions include, but are not limited to about: 5%, 10%, 15%, 20%, 25%, 30%, 35%, 40%, 45%, 50%, 55%, 60%, 65%, 70%, 75%, 80%, 85%, 90%, 95%, 100%, or more, of the dimensions of the adjacent portions of the main body 40. The dimensions for the higher specific gravity weighting portions 60 may also fall within any range defined between any two of the foregoing percentages.

The dimensions of the higher specific gravity weighting portions 60 need not all bear the same relationship to the dimensions of the adjacent portion(s) of the main body 40. Any one dimension of the higher specific gravity weighting portions 60 may bear one of the aforementioned relationships to the adjacent portion(s) of the main body 40, and any of the other dimensions of the higher specific gravity weighting portions 60 may bear a different one of the aforementioned relationships relative to the adjacent portion of the main body 40. For example, a higher specific gravity weighting portion 60 can be joined to the toe 34 of the club head 22. Such a higher specific gravity weighting portion 60 may have a length that is less than that of the adjacent portion of the main body 40 of the club head 22, but it may be thicker than the adjacent portion of the main body 40 of the club head 22. Any other possible combinations of the aforementioned relationships are also contemplated herein.

If there is more than one higher specific gravity weighting portion 60, the weighting portions 60 may be disposed or arranged in any suitable relationship with respect to each other. Any of the higher specific gravity weighting portions 60 may be spaced apart from each other, or they may be contiguous with each other. If there are more than two higher specific gravity weighting portions 60, some of the weighting portions may be spaced apart, and some of the weighting portions may be contiguous. Any of the higher specific gravity weighting portions 60 in the embodiments described herein can be contiguous. As shown in FIG. 1, the contiguous higher specific gravity weighting portions 60 can be joined by an intermediate region 58 thereof that may be reduced in any of its dimensions between the adjacent weighting portions 60B and 60C.

FIG. 1 shows one non-limiting embodiment of a club head 22 comprising first 60A, second 60B, third 60C, and fourth 60D higher specific gravity weighting portions. As shown in FIG. 1, any of the higher specific gravity weighting portions 60 may be located within a boundary element, such as in compartments. In other cases, one or more higher specific gravity weighting portions 60 may be independently joined to the main body 40 of the club head 22 and not be contained in a compartment.

In the golf club head 22 shown in FIG. 1, the first higher specific gravity weighting portion 60A is located in an optional first compartment 62A that is inside the cavity 44. The first compartment 62A is located adjacent to the heel 32 of the club head. More specifically, the first compartment 62A is adjacent to the inner surface 50A of perimeter weighting portion 50 along the heel 32 of the club head. The first compartment 62A may be joined to or contiguous with the inner surface 50A of perimeter weighting portion 50 along the heel 32 of the club head. In other embodiments, the first compartment 62A may be spaced inwardly toward the central region 48 of the club head away from the inner surface 50A of perimeter weighting portion 50 along the heel 32 of the club head. The first compartment 62A can be of any size and configuration. The compartments may be open as shown so that at least a part of the higher specific gravity weighting portion 60A is exposed, or they may be closed by some suitable type of cover so that the weighting portion 60A is partially, or completely enclosed.

The first compartment 62A is formed by a partition 64A that extends rearward from the back surface 30 of the club head 22. The partition 64A may comprise a portion of the main body 40 of the club head, or a separate component that is joined to the main body 40. The partition 64A can be joined to the back surface 30 of the club head 22 and/or to the perimeter weighted portion 50. The partition 64A can be formed of any of the materials described herein. The partition 64A can also be of any size and configuration. The partitions 64 can have any suitable length L, width W, and height (or depth) (measured from the back surface 30 of the club head). The partitions 64, when viewed from the back surface 30 of the club head 22, can be formed of a structure in the configuration of rectilinear segments, curvilinear segments, or both.

The second higher specific gravity interior weighting portion 60B is located is adjacent to the inner surface 52A of perimeter weighting portion 52 along the toe 34 of the club head. The third higher specific gravity weighting portion 60C is located is adjacent to the inner surface 54A of perimeter weighting portion 54 along the top 36 of the club head. The fourth higher specific gravity weighting portion 60D is located is adjacent to the inner surface 56A of perimeter weighting portion 56 along the sole 38 of the club head.

In addition, in this embodiment, or in other embodiments, higher specific gravity weighting portions 60 can be located in one or more of the interior corner regions that are formed inside the weighted perimeter portions 46. The higher specific gravity weighting portions 60 can be located in any of the following locations: in the interior corner region 66 where the heel portion 32 merges into the top portion 36; in the interior corner region 68 where top portion 36 merges into the toe portion 34; in the interior corner region 70 where the toe 34 merges into the sole 38; and in the interior corner region 72 where the sole 38 merges into heel 32. Any higher specific gravity weighting portions located in interior corner regions can be located within a compartment, or not located in a compartment.

The second, third, fourth, etc. higher specific gravity weighting portions and any higher specific gravity weighting portions located in the interior corner regions may have any of the features described herein as being suitable for the first higher specific gravity weighting portion 60A. In addition, any of the higher specific gravity weighting portions 60 can be located flush with the back surface 30 of the club head and/or the adjacent weighted perimeter portion 46, or they can be disposed at least partially in a recess in the back surface 30 of the club head and/or in a recess, such as recess 74 in the adjacent weighted perimeter portion 46. The weighted perimeter portions 46, or any one or more thereof, may have recesses or indentations in any of the surfaces thereof to receive at least a portion of the higher specific gravity weighting portions 60. Such recesses or indentations may be of any suitable configuration.

FIG. 2 shows that in another embodiment, the higher specific gravity weighting portions 60 can be disposed in a region along all or any portion inside the cavity 44. In the embodiment shown in FIG. 2, the width and thickness of the higher specific gravity material weighting portion 60 can be substantially constant around the inside of the cavity 44. In other embodiments, these dimensions can be varied at any suitable places inside the cavity 44.

FIG. 3 shows that in another embodiment, the higher specific gravity weighting portions 60 can be located within one or more portions of the weighted perimeter portions 46 of the club head 22. In other words, the higher specific gravity weighting portions 60 may be positioned between the inside and outside surfaces of the weighted perimeter portions 46. That is, the higher specific gravity weighting portions may be positioned in the rear surfaces 50C, 52C, 54C, and 56C of the weighted perimeter portions 46. In the particular embodiment shown in FIG. 3, there are four higher specific gravity weighting portions 60. These comprise first 60A, second 60B, third 60C, and fourth 60D higher specific gravity weighting portions.

Any of these higher specific gravity weighting portions 60 can have their rear surfaces disposed in any suitable manner relative to the back surface(s) of the weighted perimeter portions. The rear surfaces of the higher specific gravity weighting portions 60 may be disposed: (1) below the back surface (s) 50C, 52C, 54C, and 56C, of the respective weighted perimeter portions; (2) at the same level as the back surface(s) 50C, 52C, 54C, and 56C, of the respective weighted perimeter portions 50, 52, 54, and 56; or, (3) they may at least partially protrude from the back surface(s) of the weighted perimeter portions.

FIG. 4 shows that in another embodiment, the club head 22 may have higher specific gravity weighting portions 60 that are disposed outside of at least a portion of the periphery 42 of the main body 40 of the club head 22. The terms "outside" and "outward" (or "outboard"), as used herein, refer to directions that are disposed laterally away from the geometric center of the club face 28 in a direction generally parallel to the plane of the club face 28.

In the embodiment shown in FIG. 4, there are four higher specific gravity weighting portions 60 disposed outside at least a portion of the periphery 42 of the main body 40 of the club head 22. These comprise first 60A, second 60B, third 60C, and fourth 60D higher specific gravity weighting portions. The first higher specific gravity weighting portion 60A may extend outward from the heel portion 32 of the club head 22, or from the hosel 26. The second higher specific gravity weighting portion 60B may extend outward from the portion of the main body 40 at the toe 34 of the club head 22. The third higher specific gravity weighting portion 60C may extend outward from the portion of the main body 40 at the top 36 of the club head 22. The fourth higher specific gravity weighting portion 60D may extend outward from the portion of the main body 40 at the sole 38 of the club head 22. There may also be one or more higher specific gravity portions that are located outside the portions of the periphery 42 of the main body 40 that correspond to the location of the interior corner regions 66, 68, 70, and 72.

Figure 5:
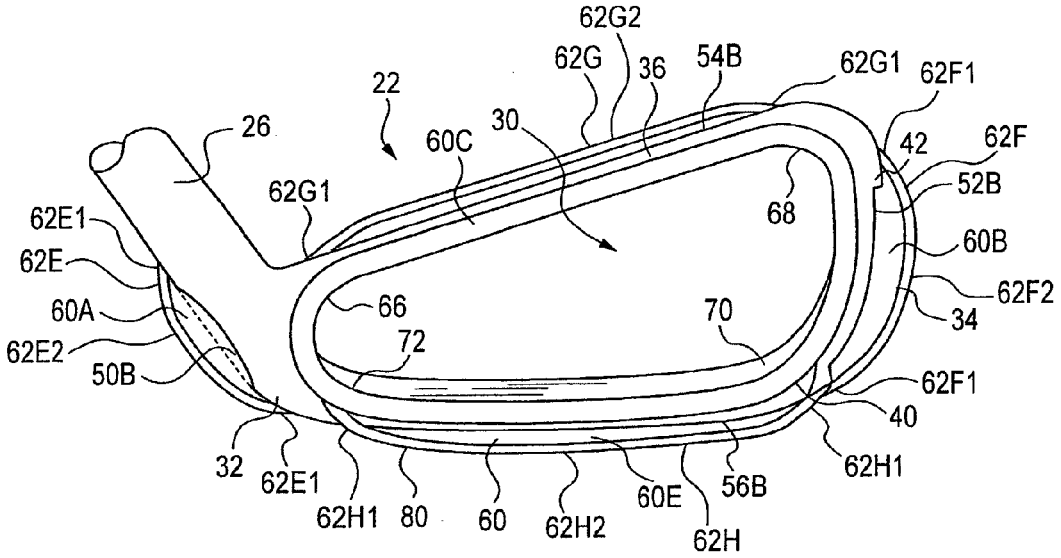
FIG. 5 is a rear elevation view of another embodiment of a golf club head which has a weighted flange.

The higher specific gravity weighting portions 60 that are disposed outside the periphery 42 of the main body 40 may have any of the properties described above for the higher specific gravity weighting portions 60 that are disposed inside the cavity, or within the perimeter weighted portions 46. For example, as shown in FIG. 4, one or more of the higher specific gravity weighting portions may be located within boundary elements 62E, 62F, 62G, 62H, such as in compartments, or in the case of the second higher specific gravity weighting portion 60B, they need not be in compartments. As shown in FIGS. 4 and 5, at least a portion of the higher specific gravity weighting portions 60 that are located outside the periphery 42 of the main body 40 may be disposed in a recess 76 in the periphery 42 of the main body 40 of the club head 22. The boundary element 62E may comprise portions, such as 62E1 that are joined to the hosel 26, and a portion 62E2 that is spaced away from the hosel 26 to define a compartment between the boundary element 62E and the hosel 26. Other boundary elements 62F, 62G, 62H may comprise portions, such as 62F1, 62G1, and 62H1 that are joined to the main body 40, and portions 62F2, 62G2, and 62H2 that are spaced apart from the main body 40 to define their respective compartments.

The higher specific gravity weighting portions, 60A, 60B, 60C, and 60D, or at least some of the same, can have an exterior configuration that forms a part of, or is a continuation of the curvature of the periphery 42 of the main body 40 of the club head 22. In other embodiments, at least some of the higher specific gravity weighting portions, 60A, 60B, 60C, and 60D, may create a discontinuity or change 78 in the curvature of the periphery 42 of the main body 40 of the club head 22. Non-limiting examples of discontinuities in the curvature of the periphery 42 of the main body 40 are breaks in the curvature, or changes in the direction of the curvature (e.g., a change from a convex curved surface to a concave curved surface or a planar surface).

FIG. 5 shows that in still other embodiments the club head 22 may comprise one or more higher specific gravity weighting portions 60E that are located in a flange 80 that extends rearwardly from the back 30 of the club head 22. Such a flange 80 can be provided to extend rearwardly from the heel 32, the toe 34, the top 36, or the sole 38 of the club head 22.

In addition, it should be understood that in still other embodiments, the club head 22 may comprise any combinations of higher specific gravity weighting portions 60 described herein. For example, in some embodiments, the club head may comprise one or more higher specific gravity weighting portions 60 that are located: inside a cavity, within a portion of the main body 40, or outside of the main body 40, or in a flange extending rearwardly from the back 30 of the club head 22. In addition, any of the weighting portions 60 described herein can be adjustable before play so that the golfer can pre-select a desired shape for the golf shots that they will hit with such clubs and/or compensate for swing faults that they may have on any given day.

Figure 6:
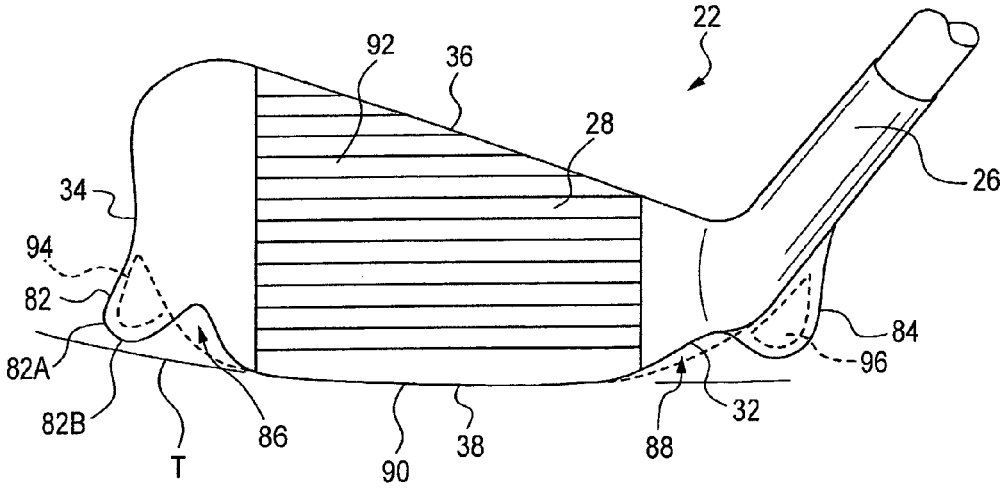
FIG. 6 is a front elevation view of an embodiment of a golf club head having extensions that extend laterally outward at the bottom of the club head.

FIG. 6 shows another embodiment of a club head 22. The club head 22 shown in FIG. 6 may be thought of as having a sole 38 with a "catamaran", or an "outrigger" configuration. The club head 22 shown in FIG. 6 comprises one or more extensions that extend laterally outward from the toe 34 and/or the heel 32 of the club head 22 at the bottom of the club head 22. These comprise first extension 82 and second extension 84, respectively. The first and second extensions 82 and 84 can be provided for any suitable purpose including, but not limited to, for the purpose of redistributing weight to extreme portions of the perimeter of the club head 22 to maximize the efficiency of the perimeter weighting. The first and second extensions, 82 and 84, may optionally comprise higher specific gravity portions 94 and 96.

As shown in FIG. 6, the first extension 82 may have a laterally outwardmost portion 82A that is disposed laterally outward at least as far, or farther than the outwardmost portion 34' near the top of the toe 34. In one version of such an embodiment, the first extension 82 may provide the toe 34 of the club head 22 with a convex configuration when the club head is viewed from the front. In addition, the first extension 82 comprises a lowermost portion 82B, and the lowermost portion 82B is disposed above the lowest portion of the sole 38 of the club head 22. The lowermost portion 82B may also be disposed above the extension of any tangent line T that follows the curvature of the sole 38 of the club head 22. The first extension 82 may, therefore, not come into contact with the ground when the golf club is swung. The second extension 84 can provide, or be provided with, features similar to those of the first extension 82.

FIG. 6 also shows an optional feature in which there is a recess or channel 86 in the sole 38 between the first extension and the portion 90 of the sole 38 that is disposed below the geometric center of the club face 28. The recess 86 in the sole 38 can be disposed in any suitable location between the first extension 82 and the portion 90 of the sole 38 that is disposed below the geometric center of the club face 28. The recess 86 in the sole 38 can be disposed inward, or outward of the grooved portion 92 of the club face 28. Alternatively, a portion of the recess 86 in the sole 38 can be disposed inward of the grooved portion 92 of the club face 38 and a portion of the recess 86 in the sole 38 can be disposed outward of the grooved portion 92 of the club face 22.

The recess 86 in the sole 38 can extend upward toward the top edge 36 of the club head 22 any suitable distance. Suitable distances include, but are not limited to about: 1/16 inch, 1/8 inch, 1/4 inch, 1/2 inch, and 1 inch or more. The recess 86 in the sole 38 can have any suitable width measured in a direction between the heel 32 and the toe 34 of the club head 22. Suitable widths include, but are not limited to about: 1/16 inch, 1/8 inch, 1/4 inch, 1/2 inch, and 1 inch or more. The recess 86 in the sole 38 can have a constant width from the club face 28 to the back 30 of the club head 22. In other embodiments, the recess 86 in the sole 38 can taper inwardly, or flare outwardly from the club face 28 to the back 30 of the club head 22. The recess 86 in the sole 38 can extend any suitable distance from the club face 28 toward the back 30 of the club head 22.

FIG. 6 also shows that there can be an optional second recess or channel 88 in the sole 38 between the second extension 84 and the portion 90 of the sole 38 that is disposed below the geometric center of the club face 28. The second recess 88 can have any of the features described for the first recess 86.

In other embodiments, either of the recesses 86 and 88 in the sole 38 of the club head 22 may have a forwardmost portion that is disposed rearwardly of the club face 28 so that the recesses 86 and 88 in the sole 38 will not be visible from the front of the club head 22.

Figure 7:
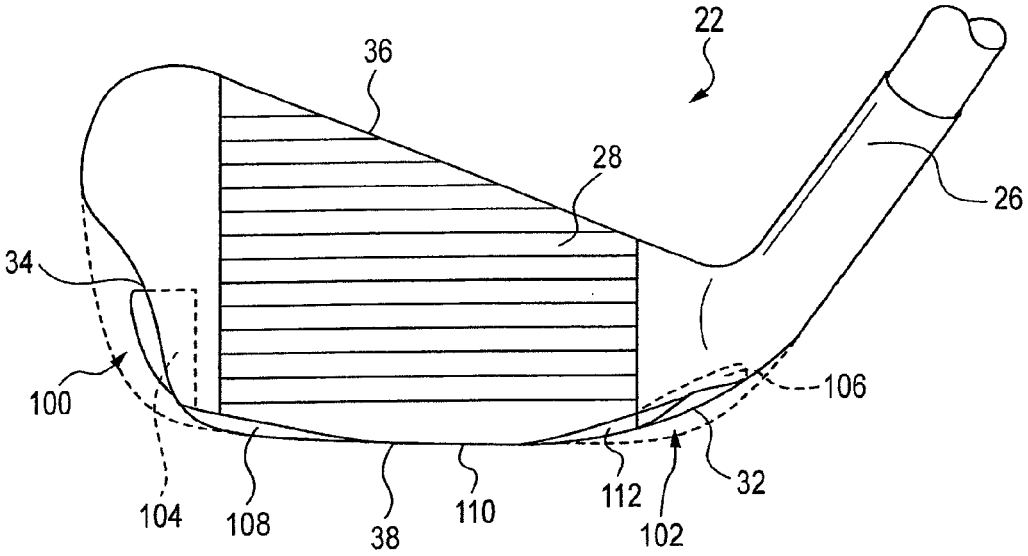
FIG. 7 is a front elevation view of another embodiment of a golf club head which has recessed regions in its toe and heel.

FIG. 7 shows that in another embodiment, the golf club comprises a club head 22 of the "iron" type that has a unique configuration. The configuration of the club head 22 shown in FIG. 7 may be used for any suitable purpose. For instance, such a configuration may provide the club head 22 with improved ability to cut through the "rough" (that is, the long grass outside of the closely cut fairway grass) on the golf course. Such an embodiment may be desirable for standard size iron club heads, or for oversized iron club heads. The term "oversized" is defined in the patents incorporated by reference herein.

While oversized metal woods have gained wide popularity, oversized irons have not yet achieved widespread use. This may be due, at least in part, to the fact that oversized irons must be used both on the fairways and in the rough. Such oversized iron club heads can often become tangled in long grass, which may cause twisting or slowing of the club head at impact, leading to errant and/or weak shots.

There are a number of ways to provide an iron type club head with improved ability to cut through long grass. In the embodiment shown in FIG. 7, the club head 22 can have recessed regions or cut out regions 100 and 102 therein. Such regions can serve to avoid entanglement of at least a part of the club head 22 in long grass, or serve any other suitable purpose. These regions 100 and 102 are visible from the club face 28 side of the club head 22. The recessed regions 100 and 102 may extend through the entire thickness of the club head 22 from the club face 28 to the back surface 30 of the club head 22. In other embodiments, however, one or more of the recessed regions 100 and 102 may only extend a portion of the way through the thickness of the club head 22.

In the embodiment shown in FIG. 7, recessed region 100 in the lower portion of the club head 22 at the toe portion 34 of the club head 22 has a concave configuration when viewed from the front of the club head 22. As used herein, the term "lower portion" can include the lower 5%-95% of the club head, or any percentage therebetween. As used herein with reference to this embodiment, the term "concave" refers to a recessed region. In such an embodiment, the concave region is recessed in comparison to the typical convex curvature found on the toe of a golf club. The typical convex curvature is shown by the dashed line to the left of the toe portion 34. The portion of the club head 22 that forms the concave recessed region 100 may comprise an entirely concave-curved surface. However, the portion of the club head 22 that forms the concave recessed region 100 is not limited in configuration to an entirely concave-curved surface. As shown in FIG. 7, the surface of the club head 22 in the concave recessed region 100 can be formed by portions that have a concave curvature and portions that have a convex curvature.

The embodiment shown in FIG. 7 also may comprise a recessed region 102 in the lower portion of the club head 22 at the heel portion 32 of the club head 22 that has a concave configuration when viewed from the front of the club head 22. The portion recessed region 102 of the club head 22 at the heel portion 32 of the club head 22 can have any of the properties described herein with reference to the recessed region 100 at the toe of the club head 22.

If desired, the recessed regions 100 and 102 can have higher specific gravity weighting portions, such as 104 and 106 disposed either at least partially therein, behind, or behind the adjacent portions of the club head 22 surrounding the recessed regions 100 and 102 to compensate for the loss mass of the material that would otherwise have been in the recessed regions 100 and 102. In some embodiments, such as those where the higher specific gravity weighting portions such as 104 and 106 can disposed at least partially behind the adjacent portions of the club head 22 surrounding the recessed regions 100 and 102, respectively, it may be desirable for at least a portion of at least one of the higher specific gravity weighting portions 104 and 106 to be within ⅛ inch, ¼ inch, or ½ inch of the periphery of the adjacent recessed region 100 and 102, respectively.

Figure 8:
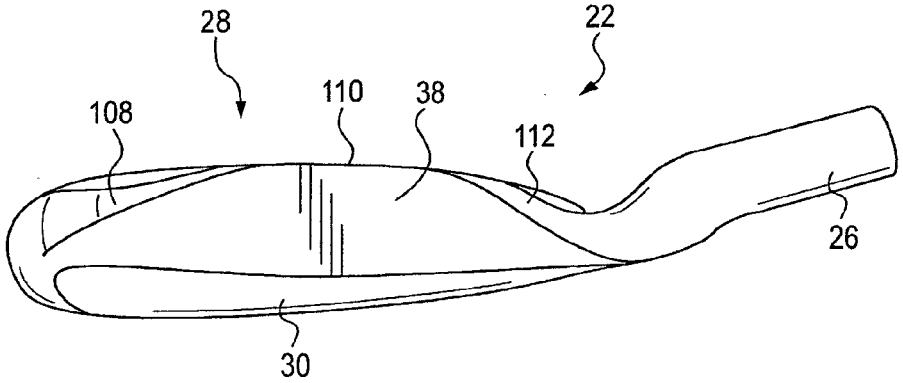
FIG. 8 is a bottom view of an embodiment of a golf club head, such as the golf club head shown in FIG. 7.

FIG. 7 and FIG. 8 show that the club head 22 can also be provided with regions, referred to herein as outer sole portions 108 and 112, along the leading edge 110 of the club head 22 at the sole 38 of the club head. The configuration of the regions 108 and 112 along the leading edge 110 of the club head 22 shown in FIG. 7 may be used for any suitable purpose. For example, the regions 108 and 112 can be configured to spread apart long grass, or to serve any other purpose (e.g., reduce tendency of golfers to hit behind the golf ball and/or to take overly large divots). In the embodiment shown in FIGS. 7 and 8, the leading edge 110 of the club head 22 comprises a region aligned with the center of the club face 28 that is disposed closer to the leading edge of the club head than the outer sole portions 108 and 112 disposed on either side of the center sole region comprising the leading edge 110. The center sole portion can have any suitable width measured in a direction between the heel and toe of the club head 22.

The outer sole portions 108 and 112 define two "faces" that diverge from the center sole portion of the club head 22. These faces may have any suitable configuration. These faces may be defined by rectilinear (or planar) surfaces, curvilinear surfaces, or by portions of both types of surfaces. These surfaces may be concave relative to the club face, or in other embodiments, they may be convex relative to the club face.

Figure 9:
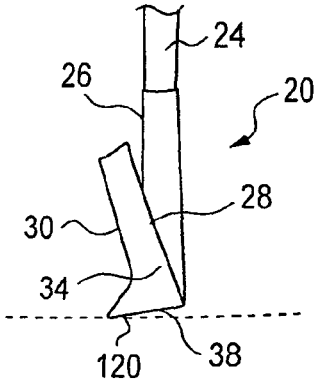
FIG. 9 is an end view of another embodiment of a golf club head as viewed from the toe end which has a sole with bounce thereon.
Figure 10:
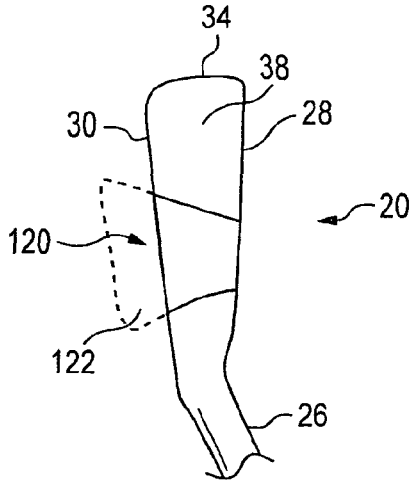
FIG. 10 is a bottom view of another embodiment of a golf club head which has a sole with bounce thereon.

FIGS. 9 and 10 show that in other embodiments, iron golf clubs 20 may be provided with a region that different types of "bounce" 120 on their soles 38. (That is, when the trailing edge of the sole 38 is below the leading edge in the square hit position.) In the embodiment shown in FIG. 9, the trailing end of the sole 38 may be rounded to prevent stubbing, or for any other purpose. As shown in FIG. 10, the club head 22 can be provided with bounce by an extension 122 from back surface of the club head at the sole 38 of the club head 22. This extension 122 can extend beyond the rear edge of the rest of the sole 38. This extension 122 may also flare outward to assist in squaring the club face at impact, or for any other purpose. In these, or other embodiments, the regions 120 providing bounce could be made of a material with higher specific gravity.

Figure 11:
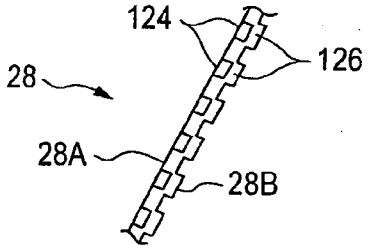
FIG. 11 is a fragmented cross-sectional view of one embodiment of a club face for a club head.
Figure 12:
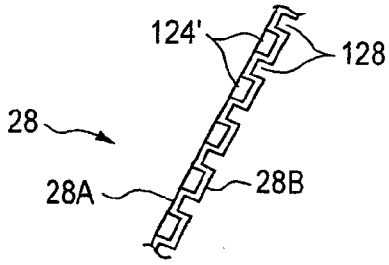
FIG. 12 is a fragmented cross-sectional view of another embodiment of a club face for a club head.

FIGS. 11 and 12 show that in other embodiments, the golf club comprises a club head having a club face 28 with at least one portion thereof that has a thickness that is modified to account for at least one of the grooves 124 in the front 28A of the club face 28. In the embodiment shown in FIG. 11, additional thickness 126 is provided behind the grooves 124. In the embodiment shown in FIG. 12, areas of reduced thickness 128 are provide outside the grooves 124'. The contours of the rear 28B of the club face 28 may, but need not be formed of rectilinear segments as shown. Curvilinear segments may also be used.

In other embodiments, correlated golf clubs are provided in which the club face is opened or closed relative to at least one other club within a set of golf clubs. Such correlated golf clubs can form a set of golf clubs, or a portion of a set of golf clubs. One problem encountered when playing golf is for some golfers there is a tendency to have a more difficult time intentionally curving (or "working") shots hit with shorter clubs than with longer clubs. Another problem is that some golfers tend to hit cut or fade shots with their irons and hook their woods, or vice versa. In the embodiments of the correlated golf clubs described herein, the face angle of the clubs within a set, or portion thereof, or which can be assembled to make a set, or portion thereof, can be varied to allow the golfer to hit shots with a consistent ball flight when using different clubs.

In one non-limiting embodiment, for example, the club faces can be made with an angle that is progressively more closed from the driver through the wedge, or in any two or more clubs that fall therebetween, so that the golfer will be able to hit a consistent "draw" or slight hook. Numerous other embodiments are possible including, but not limited to making the club faces progressively more open from the driver through the wedge, or in any two or more clubs that fall therebetween. A system and method of selling such clubs can also be used in which the clubs are provided with a unique numbering system, such as "C1" (closed 1°), C2, etc. in addition to the club number.

Numerous other embodiments of the golf clubs described herein are possible. For example, in other embodiments, the club head can be provided with more, or fewer, higher specific gravity weighting portions, or weighting portions having different configurations than those shown in each of the drawing figures. In other embodiments, any of the features of the golf clubs described herein can be combined in any suitable manner to produce still other embodiments.

Figure 13:
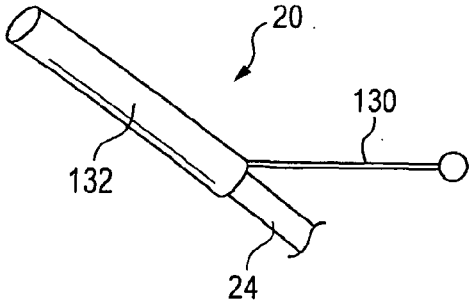
FIG. 13 is a fragmented perspective view of a portion of a golf club having a swing training device thereon.

FIG. 13 shows an embodiment of a golf swing training device 130. The golf swing training device 130 comprises a structure that is attached to the golf club 20 at or below the grip 132 of the golf club, and extends outward from the front of the golf club 120. The golf swing training device 130 can be made from any of the materials described in U.S. Patent Application Publication No. US 2003/0083140 A1. The swing training device 130 may be used for any suitable purpose, including to make the rotation of the golf club shaft 24 and/or club face 28 more visible to the golfer.

The disclosure of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

While particular embodiments of the subject invention have been described, it will be obvious to those skilled in the art that various changes and modifications of the subject invention can be made without departing from the spirit and scope of the invention. In addition, while the present invention has been described in connection with certain specific embodiments thereof, it is to be understood that this is by way of illustration and not by way of limitation.

The invention claimed is:

1. An iron type golf club head comprising a club face, said club face defining a plane and having grooves, a back surface on the opposite side of said club head from the club face, a toe portion, a heel portion, a top edge, and a sole portion extending generally between the heel portion and the toe portion, wherein said club head comprises:

(a) a main body having an exterior periphery comprising an end surface along said toe portion, said end surface along said toe portion being oriented generally perpendicular to the plane defined by said club face and an end surface along said heel portion opposite the end surface along said toe portion, said main body at least partially comprised of a material having a first specific gravity; and (b) a weighting system joined to a portion of the exterior periphery of the main body of said club head, said weighting system comprising at least one higher specific gravity weighting portion having a specific gravity greater than said first specific gravity, wherein said at least one higher specific gravity weighting portion is joined to the end surface along said heel portion, wherein at least a portion of said higher specific gravity weighting portion is at least partially located in a recess formed in the outer surface of said heel portion of said main body, wherein said higher specific gravity weighting portion being located at least partially laterally outward, in a direction generally parallel to the grooves in the club face, of said portion of the exterior periphery of said main body to which it is joined, and said higher specific gravity weighting portion is free of lead tape.

2. The golf club head of claim 1 further comprising a higher specific gravity weighting portion is joined to the end surface of said main body along said toe portion.

3. The golf club head of claim 2 wherein said club face has a geometric center, and when said club head is viewed from the rear, the periphery of said main body has an outermost portion along the toe portion, and the higher specific gravity weighting portion comprises at least a portion that is disposed further away from the geometric center of the club face than the outermost portion of the main body along the toe portion of said club head.

4. The golf club head of claim 2 wherein a portion of at least one of the end surface along the toe portion or the end surface along the heel portion has a recess therein which is recessed concavely wherein said recess has a base that has a concave curvature when viewed from at least one of the front of the club face and the rear of the club head, and at least a portion of said higher specific gravity weighting portion is at least partially located in said concavely-recessed portion.

5. The golf club head of claim 4 wherein at least a portion of said higher specific gravity weighting portion protrudes laterally outwardly from the concavely recessed portion.

6. The golf club head of claim 1 wherein said main body is perimeter weighted wherein the back surface of said club head comprises a central region which has a cavity therein, wherein the club head has a first thickness measured between said club face and said back surface of said club head, and the cavity is at least partially surrounded by thicker portions on the back surface of said club head.

7. The golf club head of claim 1 wherein said club face has a geometric center, and when said club head is viewed from the rear, the periphery of said main body has an outermost portion along the heel portion, and the higher specific gravity weighting portion comprises at least a portion that is disposed further away from the geometric center of the club face than the outermost portion of the main body along the heel portion of said club head.

8. The golf club head of claim 1 further comprising a hosel extending upward from said heel portion for receiving a golf club shaft, wherein said club face extends from one side of said hosel, and said higher specific gravity weighting portion is disposed on at least one of the heel portion of the club head and a back portion of said hosel opposite the portion of said hosel from which said club face extends.

9. The golf club head of claim 8 wherein a portion of the back surface of said hosel is recessed concavely, and at least a portion of said higher specific gravity weighting portion is at least partially located in said concavely-recessed back portion.

10. The golf club head of claim 9 wherein at least a portion of said higher specific gravity weighting portion protrudes laterally outwardly from said concavely-recessed back portion.

11. The golf club head of claim 7 wherein said main body is perimeter weighted, and the back surface of said club head comprises a central region which has a cavity therein, wherein the club head has a first thickness measured between said club face and said back surface of said club head, and the cavity is at least partially surrounded by thicker portions on the back surface of said club head.

12. The golf club head of claim 7 wherein when the sole portion of the club head is placed on a horizontal surface, the top edge of the club head has a highest portion and a lowest portion relative to said horizontal surface, and at least a portion of said higher specific gravity weighting portion is disposed lower than the lowest portion of the top edge of said club head.

13. An iron type golf club head comprising a club face, said club face defining a plane and having grooves, a back surface on the opposite side of said club head from the club face, a toe portion, a heel portion, a hosel extending upward from said heel portion for receiving a golf club shaft, a top edge, and a sale portion extending generally between the heel portion and the toe portion, wherein said club head comprises:

(a) a perimeter weighted main body wherein the back surface of said club head comprises a central region which has a cavity therein, wherein the cavity is at least partially surrounded by thicker portions on the back surface of said club head, said main body having perimeter weighted portions along one or more of the heel portion, the toe portion, the top edge, and the sole of the club head, wherein each of said perimeter weighted portions has an outer surface, said main body being at least partially comprised of a material having a first specific gravity, said main body having an outer surface, wherein a recess is formed in at least one of the outer surfaces of said perimeter weighted portions at said toe portion or said heel portion, wherein said outer surface along said toe portion is oriented generally perpendicular to the plane defined by said club face, and the outer surface at said heel portion is opposite the outer surface along said toe portion, and said recess forms an opening in the outer surface of said main body; and (b) a weighting system joined to the outer surface of the main body of said club head, said weighting system comprising at least one higher specific gravity weighting portion having a specific gravity greater than the first specific gravity of said material comprising said main body, wherein at least a portion of said higher specific gravity weighting portion is at least partially located in the recess formed in the outer surface of at least one of the perimeter weighted portions along said toe portion or said heel portion of said main body, and at least a portion of said higher specific gravity weighting portion protrudes laterally outward, in a direction generally parallel to the grooves in the club face, beyond the portion of said main body defining said recess.

14. The golf club head of claim 13 wherein said recess is in said toe portion, and said higher specific gravity weighting portion protrudes laterally outward from said perimeter weighted portion along said toe portion.

15. The golf club head of claim 13 wherein said recess is in said heel portion, and said higher specific gravity weighting portion protrudes laterally outward from said perimeter weighted portion along said heel portion.

16. An iron type golf club head comprising a club face, said club face defining a plane and having grooves, a back surface on the opposite side of said club head from the club face, a toe portion, a heel portion, a top edge, and a sole portion extending generally between the heel portion and the toe portion, wherein said club head comprises:

(a) a main body having an exterior periphery comprising an end surface along said toe portion, said end surface along said toe portion being oriented generally perpendicular to the plane defined by said club face and an end surface along said heel portion opposite the end surface along said toe portion, and wherein a portion of said exterior periphery of the main body of the club head has a concave curvature that extends through the entire thickness of the club head from the club face to the back surface of the club head when viewed from the front of the clubface, said main body at least partially comprised of a material having a first specific gravity; and (b) a weighting system joined to the exterior periphery of the main body of said club head, said weighting system comprising at least one higher specific gravity weighting portion having a specific gravity greater than said first specific gravity, wherein said at least one higher specific gravity weighting portion is joined to at least one of said end surface along said toe portion and said end surface along said heel portion, wherein at least a portion of said higher specific gravity weighting portion is at least partially located in a recess formed in the outer surface of said at least one of said heel and toe portion of said main body, wherein said higher specific gravity weighting portion being located at least partially laterally outward in a direction generally parallel to the grooves in the club face of said portion of the exterior periphery of said main body to which it is joined, and said higher specific gravity weighting portion is free of lead tape.

17. The golf club head of claim 16 wherein the portion of the exterior periphery of the main body with the concave curvature comprises part of said heel portion.

18. The golf club head of claim 4 wherein the concavely-recessed portion is not visible from the front of the club head.

19. The golf club head of claim 16 wherein the portion of the exterior periphery of the main body with the concave curvature comprises part of said toe portion.

* * * * *